US006675540B1

(12) United States Patent
Rokes

(10) Patent No.: US 6,675,540 B1
(45) Date of Patent: Jan. 13, 2004

(54) PORTABLE BUILDING FOR HUMAN OCCUPANCY

(76) Inventor: Tracy Rokes, 5814 Westminster Dr., Cedar Falls, IA (US) 50613

( * ) Notice: Subject to any disclaimer, the term of this patent is extended or adjusted under 35 U.S.C. 154(b) by 0 days.

(21) Appl. No.: 09/950,945

(22) Filed: Sep. 12, 2001

(51) Int. Cl.[7] ..... E04B 1/34; E04B 1/12

(52) U.S. Cl. ..... 52/143; 52/79.9; 52/79.12; 52/481.1; 52/630; 220/1.5; 220/23.87; 296/24.1; 296/37.2

(58) Field of Search ..... 52/143, 79.1, 79.7, 52/79.8, 79.9, 64, 299, 650.3, 263, 272, 630, 481.1, 79.12; 405/128, 129, 55–59; 586/249, 259; 220/1.5, 69, 688, 592; 228/23.87, 23.86, 23.83; 296/24.1, 37.2

(56) References Cited

U.S. PATENT DOCUMENTS

| | | | | | |
|---|---|---|---|---|---|
| 3,492,767 | A | * | 2/1970 | Pincus | |
| 4,159,844 | A | * | 7/1979 | Weiner | 296/37.1 |
| 4,499,696 | A | * | 2/1985 | Freeauf | 52/79.8 |
| 4,882,883 | A | * | 11/1989 | Horn | 52/79.1 |
| 5,237,784 | A | * | 8/1993 | Ros | 52/79.5 |
| 5,511,908 | A | * | 4/1996 | Van Valkenburgh et al. | 405/128 |
| 5,660,005 | A | | 8/1997 | Tacoma | |
| 5,706,615 | A | * | 1/1998 | Bridges et al. | 52/105 |
| 5,752,835 | A | * | 5/1998 | Whitmer, Sr. | 434/226 |
| 5,784,837 | A | * | 7/1998 | Klein et al. | 52/143 |
| 5,890,341 | A | * | 4/1999 | Bridges et al. | 52/745.2 |
| 6,035,590 | A | * | 3/2000 | Lindsay | 52/143 |
| 6,038,824 | A | * | 3/2000 | Hamrick, Sr. | 52/143 |
| 6,155,747 | A | * | 12/2000 | Payne et al. | 405/128 |
| 6,179,522 | B1 | * | 1/2001 | Sanford et al. | 405/128 |

OTHER PUBLICATIONS

Advertising Brochure: ABS Advantage Building Systems, L.L.C. , 2027 NW Brickyard Road, Topeka, KS 66618.

* cited by examiner

*Primary Examiner*—Carl D. Friedman
*Assistant Examiner*—Yvonne M. Horton
(74) *Attorney, Agent, or Firm*—Allan L. Harms

(57) ABSTRACT

A robust portable building for use by persons for meetings, classroom use, entertainment facilities, trade show displays, or for human habitation, which provides an entry height of only seventeen inches above ground surface and which has the look, feel, and strength of a permanent structure. The building will withstand tornadic and hurricane level winds without the requirement of tie downs or permanent installation on a foundation. The structural members of the building are primarily steel components. A rigid steel frame is supported on pairs of steel rollers each of which has a diameter which is approximately equal in size to its surface width. All structural components are screwed or welded at their junctions with other structural components. A sheet of aluminum is mechanically fixed to the upper sides of the floor joists, over which are placed additional flooring layers. Each layer is fastened securely to the floor joists. Exterior finishing and interior finishing may be applied as desired, along with installation of wiring, plumbing and HVAC requirements made in a conventional manner. The frame is provided with hooks at opposing ends to allow the building to be winched onto a trailer from either end.

13 Claims, 5 Drawing Sheets

PORTABLE BUILDING FOR HUMAN OCCUPANCY

STATEMENT REGARDING FEDERALLY SPONSORED RESEARCH OR DEVELOPMENT

Not Applicable.

BACKGROUND OF THE INVENTION

This invention relates to portable buildings for human use and occupancy, particularly to portable structures which may be moved without disassembly.

Conventionally, portable buildings for use as offices, classroom space, trade show exhibition and the like have been constructed in the same manner as mobile homes, that is, with wooden frame construction on a light weight frame supported on trailer wheels, that is, wheels with tires which may be used for highway use. These buildings of necessity require ramps or elevators to be built alongside the portable building to allow handicapped access, due to the floor of the building being supported on wheels and hence the floor being elevated from grade level by two feet or more. In addition, mobile home style buildings are well known to be susceptible to wind damage and destruction from tornado or hurricane winds even if strapped to the ground.

In some cases, portable buildings have been factory constructed of wood framing without wheels to be hauled to a desired location, to be placed on a concrete slab for use to house communication switching or other utility uses. In the case of such designs, a crane must be brought to the building site to lift the building from its transport vehicle and to place it on the slab. Frequently, additional crane services are required to lift and reposition such a structure before its final positioning is complete. Hence, the added expense of crane service is needed to locate such a portable structure.

An alternative portable building which is designed for easy assembly and disassembly is described in U.S. Pat. No. 5,660,005. This type of erectable building requires laborers to be employed to disassemble and reassemble the building at its desired location.

There is a need for a portable building which is sufficiently massive to be highly resistive to damage from high winds, one which can be moved by loading on a trailer, and one which provides a lower access height for entry of the building from grade level.

SUMMARY OF THE INVENTION

The present invention is a robust portable building for use by persons for meetings, classroom use, entertainment facilities, trade show displays, or for human habitation, which provides an entry height of only seventeen inches above ground surface. The purpose of this invention is to provide a mobile building which has the look, feel, and strength of a permanent structure.

The structural members of the building are primarily steel components. A rigid steel frame is supported on pairs of steel rollers each of which has a diameter which is approximately equal in size to its surface width. A pair of longitudinal rails are fixed by welding to the underside of the frame and cross bars are mounted transversely to the longitudinal beams and welded at their ends to the long sides of the frame. Multiple steel floor joists are mounted transversely to the longitudinal axis of the frame, being welded at each end to the long sides of the frame. The floor joists are steel wall stud components. A sheet of aluminum is mechanically fixed to the upper sides of the floor joists, over which is placed a plywood or fiberboard layer, followed by an insulating sheet, with another plywood layer above the insulating sheet. Each layer is fastened securely to the floor joists.

The sidewalls of the building are constructed of steel wall studs mounted uprightly along all sides of the frame, with a steel tying beam securing the upper ends of the wall studs. All structural components are screwed or welded at their junctions with other structural components.

The roof includes a multiplicity of steel wall stud members serving as roof rafters supported at the ends thereof on the long walls of the building. Each roof rafter has a pair of elongate truss members fastened to it, with ends of the truss members abutting along the longitudinal centerline of the building such that a peak is created along the centerline and a small downward slope exists in the roof on either side of the centerline. Insulation such as fiberglass batts may be installed between adjacent roof rafters as well as in the spaces between adjacent wall stud members. A roof deck is mechanically fastened over the truss members and a rubber membrane is adhesively secured to the roof deck. Exterior finish materials may be applied to the outside of wall stud members. Interior finishing may be applied to interior surfaces as desired, along with installation of wiring, plumbing and HVAC requirements made in a conventional manner.

The frame is provided with hooks at opposing ends to allow the building to be winched onto a trailer from either end.

The interior may be provided with room partitions and the exterior walls fitted with doors and windows as desired. Plumbing, lighting, and electrical fixtures may be provided as desired, depending on the use to which the building is to be put.

It is a primary object of the invention to provide a portable building for human occupancy which will withstand tornadic and hurricane level winds without the requirement of tie downs or permanent installation on a foundation.

Further objects of the invention are: (a) to provide a portable building which can be transported to a desired placement location on a flatbed truck; (b) to provide a portable building which may be loaded and unloaded from a transport vehicle without the use of a crane or other lifting device; (c) to provide a portable building which has its entryway near grade level to reduce the length of ramps needed for accessibility; (d) to provide a versatile portable building which may be used for varied uses; (e) to provide a portable office or meeting room with amenities desired by the user, including restroom, spa, theater, or media presentation area.

These and other objects of the invention will become apparent from examination of the description and claims which follow.

BRIEF DESCRIPTION OF THE SEVERAL VIEWS OF THE DRAWING(S)

DETAILED DESCRIPTION OF THE INVENTION

Figure 1:
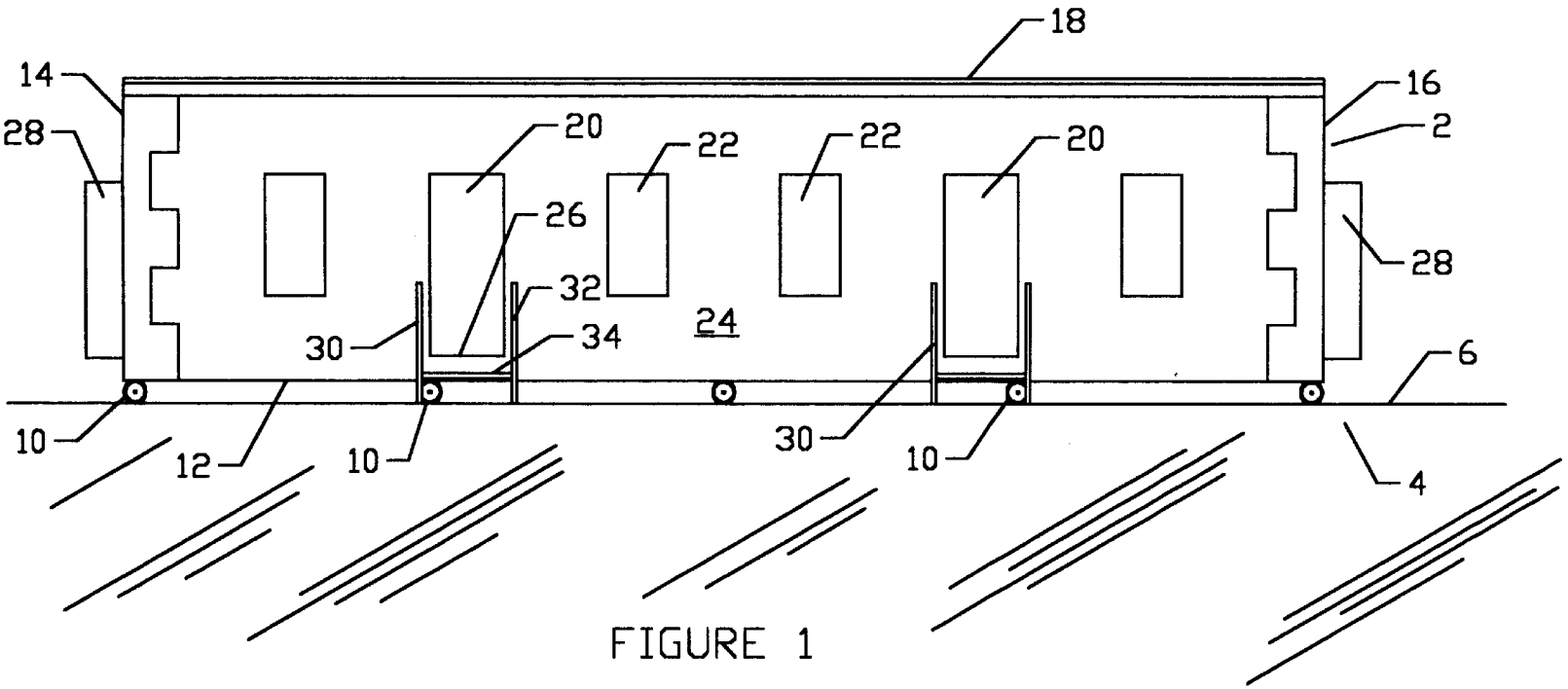
FIG. 1 is a front elevation of the preferred embodiment portable building of the present invention.

FIG. 1 illustrates the preferred embodiment of the invention portable building 2 resting on a ground surface 4 having grade level 6. Building 2 is supported on multiple rollers 10 which are preferable approximately nine inches in diameter and nine inches in width though adequate rollers would be in the range from three inches to twelve inches in diameter. Rollers 10 are spaced generally equidistantly along the length of building 2, preferably approximately at eight foot intervals. Rollers 10 are constructed primarily of steel to function adequately to support the building 2.

Building 2 is equipped with doors 20 and windows 22 positioned in the wall 24 as desired according to the purpose to be made of building 2. Stoops 30 with railings 32 and platform 34 may be used at each door 10 to provide step access through doors 10. Should wheelchair access be required, a short ramp may be used in place of either stoop 30 since undercarriage 12 of building 2 will only be approximately nine inches above grade level 6. Of course, door 10 must be elevated above the undercarriage 12 and hence thresholds 26 of doors 10 will be elevated approximately seventeen inches above grade level 6. Building 2 is provided with a roof 18 and opposing end walls 14, 16 on which may be mounted utility units 28 which may house air conditioning and heating equipment, along with electrical, plumbing and other utility connections.

Figure 2:
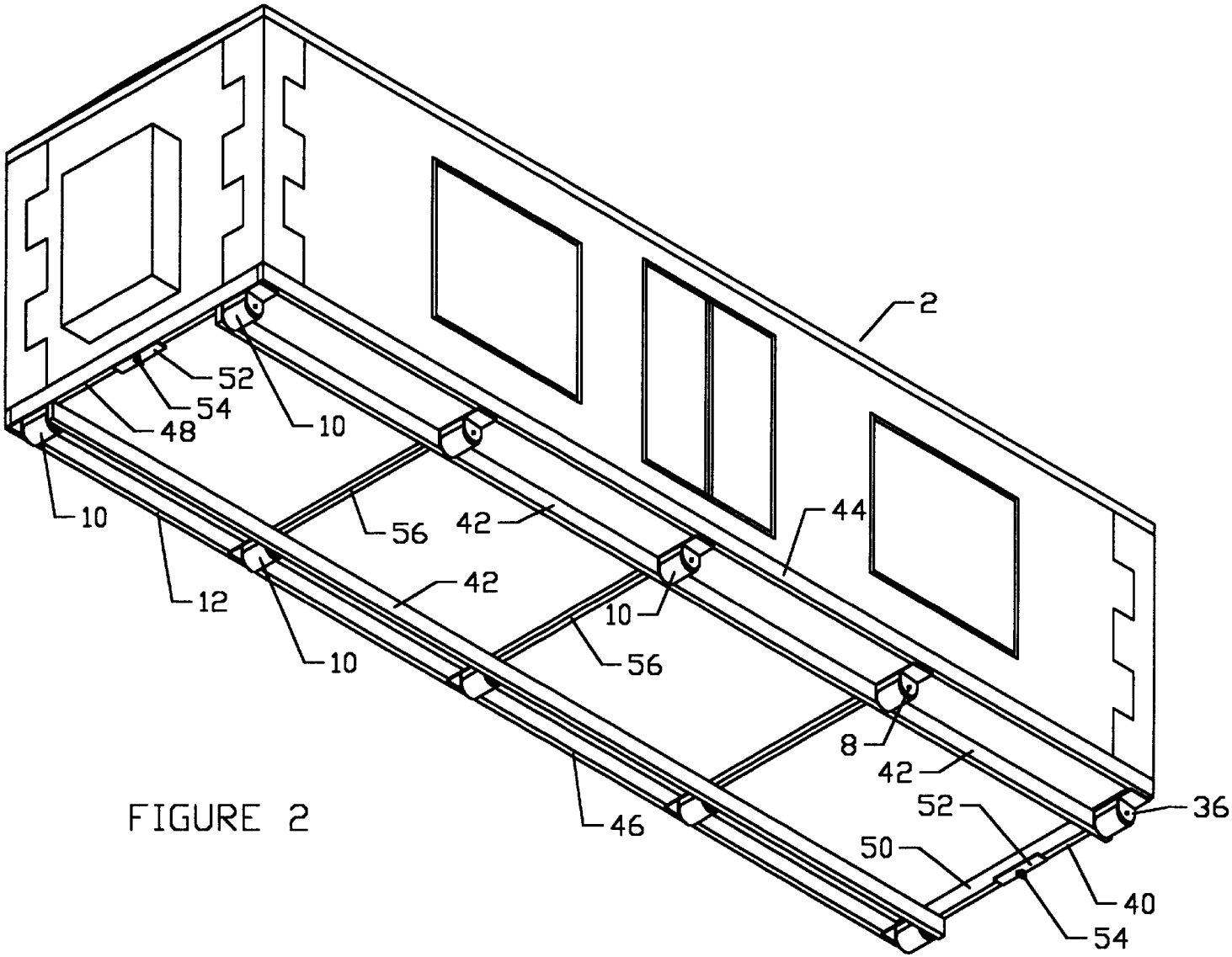
FIG. 2 is a perspective view of the undercarriage of the preferred embodiment of the invention shown with an alternative door and window arrangement.

The detail of the undercarriage 12 of building 2 may be viewed in FIG. 2. Undercarriage 12 comprises a frame 40 which defines the periphery of undercarriage 12. Beams are mounted longitudinally along undercarriage 12 the full length of building 2. Beams 42 and frame 40 are preferably constructed of 3"×8"×¼" steel tube. The members of frame 40 are welded at the corners of frame 40 and beams 42 are welded to the ends of frame 40. Beams 42 are spaced apart and each is disposed approximately two feet from one of longitudinal side members 44, 46 of frame 40. Each end member 48, 50 of frame 40 includes a reinforcing plate 52 fixed to the underside thereof by welding. Each reinforcing plate 52 is centered on end members 48 and 50 and is approximately three feet in length. A hook 54 depends from approximately the midpoint of each reinforcing plate 52 to provide a connection point for attachment of a cable to draw building 2 in a longitudinal path.

Rollers 10 are arranged in pairs, with each roller 10 mounted below a transverse bar 56 and located adjacent to and outboard of a beam 42. Each roller 10 is supported on a roller frame 36 on axle 8. Each transverse bar 56 is oriented at a perpendicular to beams 42 and is welded thereto with transverse bars 56 overlying beams 42. Transverse bars 56 are also welded at their ends to side members 44, 46. Transverse bars 56 are preferably constructed of 3"×3"×¼" steel tube.

Figure 3:
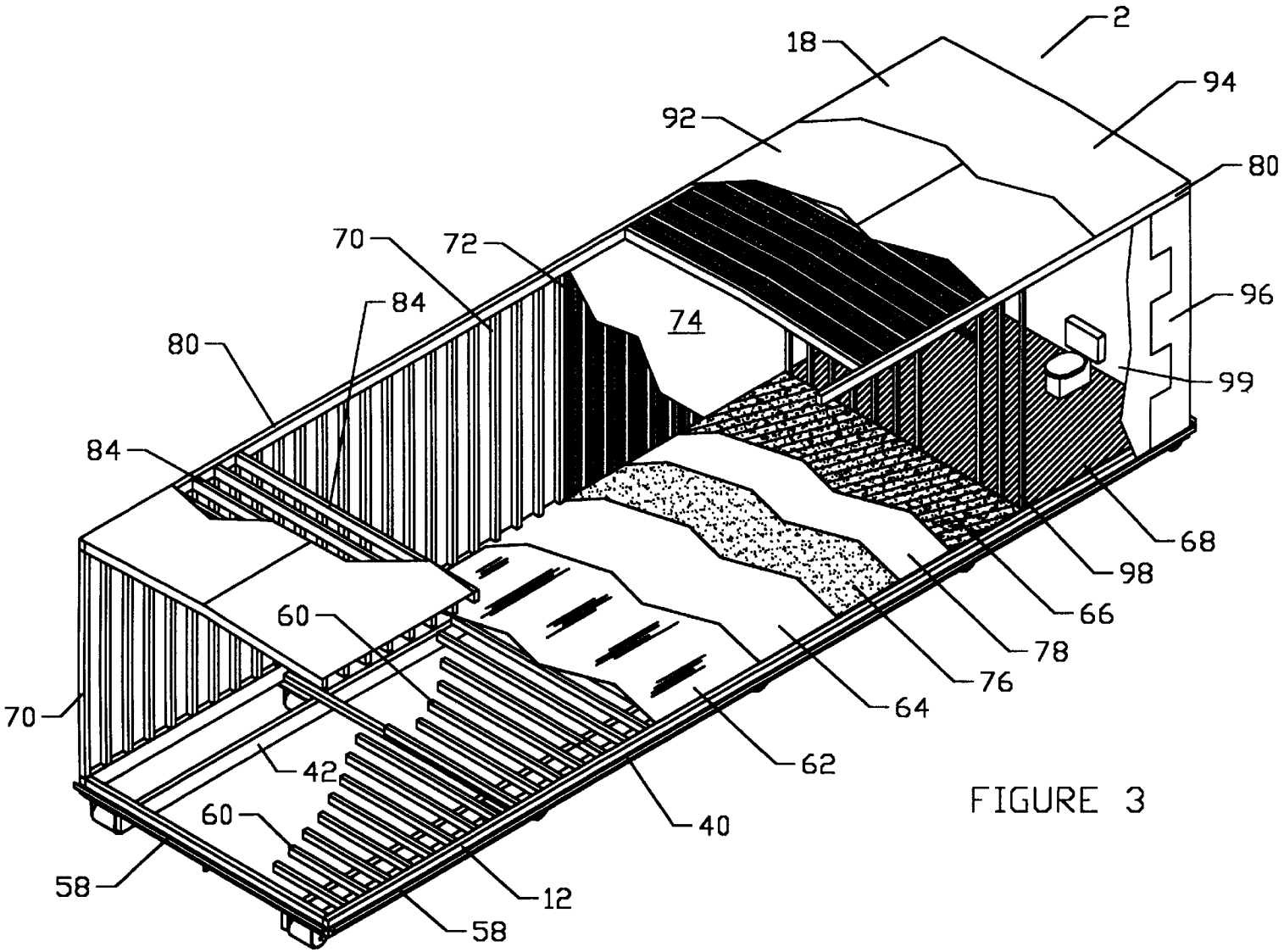
FIG. 3 is a cut away perspective of the preferred embodiment of FIG. 1.

Referring now to FIG. 3, the detail of the superstructure of portable building 2 may be observed. Beams 42 support steel floor joists 60 which lie transversely in spaced apart arrangement (twelve inches on center) along the length of frame 40. Floor joists 60 are channel-shaped galvanized steel framing members which are typically 3⅝ inches high and 2½ inches wide and extend between side members 44, 46 of frame 40 and are welded at their ends to side members 44, 46. Overlying floor joists 60 is aluminum sheet 62 which is mechanically fastened such as by screws to floor joists 60. Insulation may be installed between joists 60 and below aluminum sheet 62.

Overlying aluminum sheet 62 is plywood sheet 64 which is mechanically fastened to floor joists 60. An insulating layer 76 of styrofoam or other sheet insulation may overlie plywood sheet 64. Overlying insulating layer 76 is preferably a tongue and groove plywood layer 78. Carpeting 66, vinyl or ceramic tile 68 or other floor coverings may be applied to tongue and grove plywood layer 78.

If desired, another aluminum sheet may be secured to the underside of floor joist 60 to enclose the space between joists 60.

The walls of building 2 are constructed of wall studs 70 which upstand from frame 40 around the periphery thereof. Wall studs 70 are steel framing members of sixteen gauge galvanized steel of 3⅝"×2½" dimension. Insulation 72 in batts or other forms may be installed between adjacent studs 70. Studs 70 may be sheathed exteriorly and interiorly with one-half inch plywood sheets and gypsum wallboard 74 may be applied to the interior walls.

Figure 5:
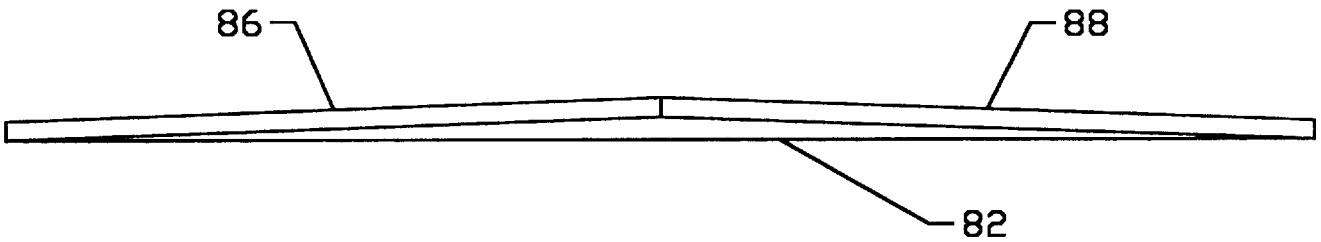
FIG. 5 is a closeup elevation of a roof truss of the present invention.
Figure 6:
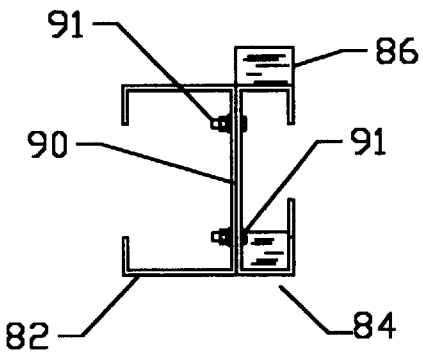
FIG. 6 is a close up plan view of the roof truss of FIG. 5.

Upstanding wall studs 70 support roof frame 80 which surrounds roof 18. Roof frame 80 supports trusses 84 which comprise galvanized steel framing members. (See FIGS. 5, 6). Each truss 84 comprises rafter 82 to which is mounted a first truss member 88 and a second truss member 86 which abut at their central ends. Rafters 82 comprise channel-shaped steel framing members which may be 3⅝"×2½" in cross section. Attached to the web 90 of rafter 82 by fasteners 91 are the first truss member 88 and second truss member 86 such that each truss member rises toward the center of rafter 82, thereby creating a slight centerline peak on roof 18. The rise of the roof 18 from edge to center is preferably one-fourth inch per foot.

A plywood deck 92 is applied to trusses 84 and is mechanically fastened thereto. A rubber sheet membrane 94 may be adhered to plywood deck 92 to complete the covering of roof 18.

Exterior siding 96 of attractive quality is applied to the exterior sheathing of the walls and is supported on L-shaped bracket 58 which extends outwardly from frame 12 at the upper end thereof.

It can be seen in FIG. 3 that the interior of building 2 may be divided into rooms such as by partition wall 98 which separates restroom 99 from the remainder of the interior of building 2. Toilet facilities may be provided in restroom 99 if desired.

It is to be understood that the extensive use of steel components in building 2 and their interconnection by welding or other secure connection create a very heavy and very strong enclosure. The typical weight of an approximate 12'×40' building 2 is about forty thousand pounds which makes building 2 very unlikely to be moved or overturned or buckled in the severest of wind conditions. The building may be winched onto a sloping flatbed truck by use of either hook 54. The building 2 can easily be transported to a desired location, lowered from the tilting flatbed trailer and drawn into its desired location on its rollers 10. Exact positioning can easily be accomplished while building 2 rests on the ground and no crane need be called to off load or load the building or to position it.

Figure 4:
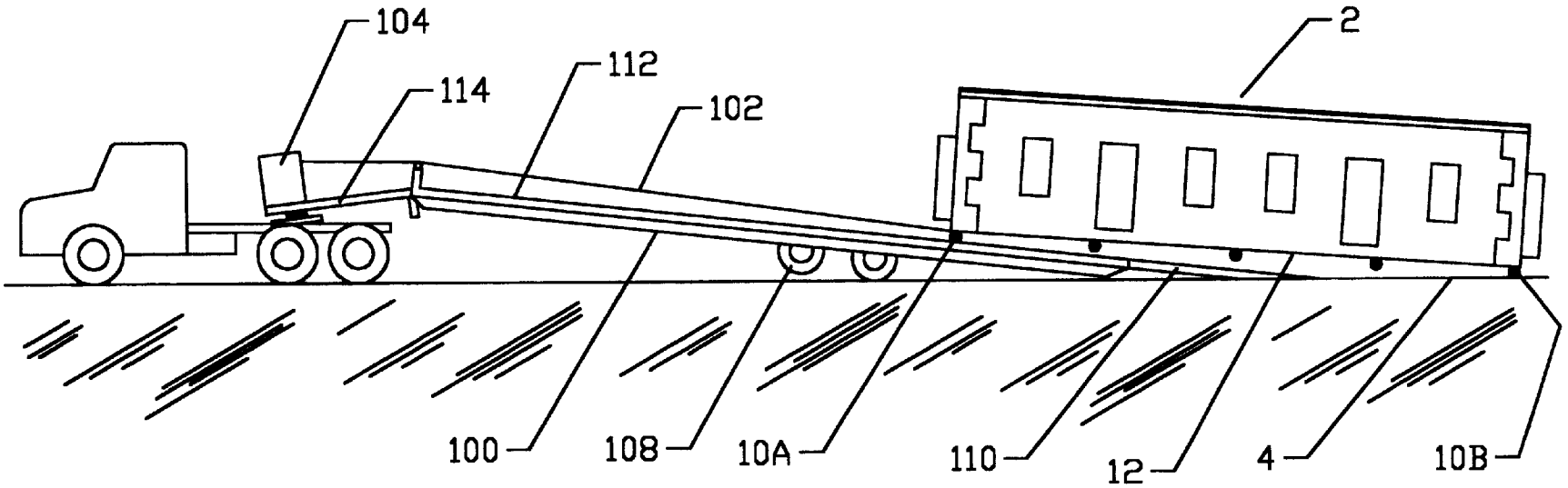
FIG. 4 is a front elevation of a building constructed according to the invention being loaded onto a trailer.

It may be seen in FIG. 4 that a tiltable trailer such as a hydraulic sliding axle trailer 100 may be used to transport building 2. Because of the rigidity of the undercarriage 12 of building 2, building 2 may be drawn onto trailer 100 by use of a winch cable 102 reeled up by winch 104. When building 2 is to be loaded onto trailer 100, tailgate 110 is lowered into alignment with trailer deck 112 and wheels 108 are moved forward to allow trailer deck 112 to slope toward its rear end and tailgate 110 slopes downward touching grade surface 4. Building 2 is rolled onto trailer deck 112 supported by the leading pair of rollers 10A and by trailing set of rollers 10B. Once trailing set of rollers 10B reaches tailgate 110, building 2 will then rest on all of its rollers 10 and once building 2 is advanced along trailer deck 112 past tailgate 110, wheels 108 may be returned to their travel position rearward along trailer 100 and trailer deck 112 will return to alignment with forward deck 114. Tailgate 110 is then pivoted into a raised position and building 2 may be secured to trailer 100 for transport. Offloading of building 2 is accomplished by reversing the process of loading.

I claim:

1. A portable building for human occupancy comprises an enclosure having a floor, a roof, and sidewalls interconnecting the roof and the floor, the enclosure having opposing longitudinal ends defining its length, the enclosure supported on a plurality of rollers disposed at the longitudinal ends of the enclosure, each roller having an axis, each roller being constructed entirely of metal, the axis of each roller parallel with the axis of the other rollers, the sidewalls of the enclosure comprising a pair of substantially parallel long walls each having opposing ends, the long walls joined at the ends thereof by a pair of substantially parallel short walls, the floor comprising a pair of parallel elongate beams each having opposing ends, an open rectangular steel frame supported on the ends of the elongate beams and fixed thereto, a series of rollers supported on each of the beams, the rollers carried on axles perpendicularly extending from the beams, the axles spaced apart generally equidistantly along each of the beams, the frame comprises a multiplicity of transverse bars fixed at ends thereof to the frame and supported upon the beams, the transverse bars each perpendicular to the beams, a series of steel joists arranged in parallel side-by-side arrangement along the length of the frame, each steel joist having ends fixed to the frame, the steel joists having top surfaces and bottom surfaces, the floor further comprising metal sheeting fixed to the top surfaces of the steel joists creating a substantially flat planar upper surface, plywood sheeting mounted to the upper surface to cover the upper surface completely, thermal insulation disposed in the spaces defined by the steel joists.

2. The portable building of claim 1 wherein metal sheeting fixed to the bottom surfaces of the steel joists to completely enclose the spaces defined by the steel joists.

3. The portable building of claim 1 wherein the sidewalls comprise a multiplicity of spaced apart upright elongate steel studs, each stud having a lower end and an upper end, the lower end of each stud fixed to the frame, a roof frame fixed to the upper end of each stud, the roof frame supporting a roof truss assembly, the roof truss assembly comprising a multiplicity of spaced apart, generally equidistant, parallel roof truss members, each roof truss member having a first end and an opposing second end, the ends of each truss member fixed to the roof frame, each roof truss member comprising a first truss element and a second truss element, each first truss element having a fixed end and an inclined end, each second truss element having a fixed end and an inclined end, the inclined end of each first truss element joined to the inclined end of a second truss element whereby each roof truss has a central peak, thermal insulation disposed between adjoining pairs of roof truss members, a roof deck supported upon the roof truss members.

4. A portable building comprises an enclosure having a floor, a roof, and sidewalls interconnecting the roof and the floor, the enclosure having a longitudinal axis and having opposing ends defining its length, the enclosure supported on a plurality of rollers, at least one roller disposed at each end of the enclosure, each roller rotatable about a fixed horizontal axis perpendicular to the longitudinal axis of the enclosure.

5. The portable building of claim 4 wherein each roller is axially elongate and has an axial length, each roller having a radius not exceeding the axial length of the roller.

6. The portable building of claim 4, wherein the floor comprises a pair of parallel longitudinal beams each having opposing ends, each of the rollers mounted adjacent one of the beams, the rollers spaced apart generally equidistantly along each of the beams.

7. The portable building of claim 6 wherein the floor further comprises an open rectangular frame supported on the ends of the elongate beams and fixed thereto, a multiplicity of transverse bars fixed at the ends thereof to the frame and supported upon the beams, the transverse bars each perpendicular to the beams, each roller supported on a roller frame, each roller frame fixed to one of the transverse bars.

8. The portable building of claim 7 wherein a plurality of steel joists is arranged in parallel spaced apart arrangement along the length of the frame, each steel joist having ends fixed to the frame, each of the steel joists having a top surface and a bottom surface, metal sheeting fixed to the top surfaces of the steel joists creating a substantially flat planar upper surface.

9. The portable building of claim 8 wherein plywood sheeting is mounted to the upper surface to substantially completely cover the substantially flat planar upper surface, thermal insulation disposed in spaces defined by the steel joists.

10. The portable building of claim 9 wherein elongate L-shaped brackets are mounted to the exterior of said frame, the L-shaped brackets having vertical legs joined to horizontal legs, each of the vertical legs fixed to said frame, each of the horizontal legs extending outwardly from said frame, exterior siding overlying said sidewalls supported on said horizontal legs of the L-shaped brackets.

11. The portable building of claim 10 wherein metal sheeting is fixed to the bottom surfaces of the steel joists to completely enclose the spaces defined by the steel joists.

12. The portable building of claim 6 wherein the sidewalls comprise a multiplicity of spaced apart upright elongate steel studs, each stud having a lower end and an upper end, the lower end of each stud fixed to the floor, a roof frame fixed to the upper end of each stud, the roof frame supporting a roof truss assembly, the roof truss assembly comprising a multiplicity of spaced apart, generally equidistant, parallel roof truss members, each roof truss member having a first end and an opposing second end, the ends of each truss member fixed to the roof frame, each roof truss member comprising a first truss element and a second truss element, each first truss element having a relatively lower end and a relatively higher end, each second truss element having a relatively lower end and a relatively higher end, the relatively higher end of the first truss element of each roof truss joined to the relatively higher end of the second truss element thereof whereby each roof truss has a central peak, thermal insulation disposed between adjoining pairs of roof truss members, a roof deck supported upon the roof truss members.

13. The portable building of claim 12 wherein the floor comprises a pair of parallel longitudinal beams each having opposing ends, each of the rollers mounted adjacent one of the beams, the rollers spaced apart generally equidistantly along each of the beams, the floor further comprises an open rectangular frame supported on the ends of the elongate beams and fixed thereto, a multiplicity of transverse bars fixed at the ends thereof to the frame and supported upon the beams, the transverse bars each perpendicular to the beams, each roller supported on a roller frame, each roller frame fixed to one of the transverse bars, a plurality of joists is arranged in parallel spaced apart arrangement along the length of the frame, each joist having ends fixed to the frame, each of the joists having a top surface and a bottom surface, metal sheeting fixed to the top surfaces of the joists creating a substantially flat planar upper surface, each roller axially elongate having an axial length, each roller having a radius not exceeding the axial length of the roller.

* * * * *